US009909434B2

(12) United States Patent
Tsifourdaris et al.

(10) Patent No.: US 9,909,434 B2
(45) Date of Patent: Mar. 6, 2018

(54) INTEGRATED STRUT-VANE NOZZLE (ISV) WITH UNEVEN VANE AXIAL CHORDS

(71) Applicant: Pratt & Whitney Canada Corp., Longueuil (CA)

(72) Inventors: Panagiota Tsifourdaris, Montreal (CA); Edward Vlasic, Baie D'urfe (CA); Niloofar Moradi, Cote Saint-Luc (CA); Francois Doyon, Ste-Julie (CA)

(73) Assignee: PRATT & WHITNEY CANADA CORP., Longueuil, QC (CA)

( * ) Notice: Subject to any disclaimer, the term of this patent is extended or adjusted under 35 U.S.C. 154(b) by 285 days.

(21) Appl. No.: 14/939,237

(22) Filed: Nov. 12, 2015

(65) Prior Publication Data

US 2017/0022832 A1 Jan. 26, 2017

Related U.S. Application Data

(60) Provisional application No. 62/196,486, filed on Jul. 24, 2015.

(51) Int. Cl.

| | |
|---|---|
| ***F01D 9/04*** | (2006.01) |
| ***F01D 9/06*** | (2006.01) |
| *F01D 5/14* | (2006.01) |

(52) U.S. Cl.

CPC ..... *F01D 9/04* (2013.01); *F01D 9/065* (2013.01); *F01D 5/142* (2013.01); *F05D 2240/128* (2013.01)

(58) Field of Classification Search

CPC . F01D 5/142; F01D 9/04; F01D 9/065; F01D 17/10; F05D 2240/128

See application file for complete search history.

(56) References Cited

U.S. PATENT DOCUMENTS

| | | | | |
|---|---|---|---|---|
| 2,941,781 | A * | 6/1960 | Boyum | F01D 25/162 415/142 |
| 3,604,629 | A | 9/1971 | Colville | |
| 3,617,147 | A | 11/1971 | Bragg | |
| 3,704,075 | A | 11/1972 | Karstensen et al. | |

(Continued)

FOREIGN PATENT DOCUMENTS

| | | |
|---|---|---|
| GB | 1058759 | 2/1967 |
| GB | 1534124 | 11/1978 |
| GB | 2226600 | 7/1990 |

OTHER PUBLICATIONS

Office Action issued in related U.S. Appl. No. 13/788,474 dated May 16, 2017.

(Continued)

*Primary Examiner* — Igor Kershteyn

(74) *Attorney, Agent, or Firm* — Norton Rose Fulbright Canada LLP

(57) ABSTRACT

An integrated strut and turbine vane nozzle (ISV) comprising: inner and outer duct walls defining a flow passage therebetween, an array of circumferentially spaced-apart struts extending radially across the flow passage, and an array of circumferentially spaced-apart vanes extending radially across the flow passage. At least one of the struts is aligned in the circumferential direction with an associated one of the vanes and forms therewith an integrated strut-vane airfoil. The adjacent vanes on opposed sides of the integrated strut-vane airfoil have uneven axial chords relative to the other vanes.

20 Claims, 3 Drawing Sheets

(56) References Cited

U.S. PATENT DOCUMENTS

| | | | | |
|---|---|---|---|---|
| 3,745,629 | A | 7/1973 | Pask et al. | |
| 4,478,551 | A | 10/1984 | Honeycutt, Jr. et al. | |
| 4,595,340 | A | 6/1986 | Klassen et al. | |
| 4,793,770 | A | 12/1988 | Schonewald et al. | |
| 4,989,406 | A | 2/1991 | Vdoviak et al. | |
| 5,207,556 | A | 5/1993 | Frederick et al. | |
| 6,045,325 | A | 4/2000 | Horvath et al. | |
| 6,082,966 | A | 7/2000 | Hall et al. | |
| 6,331,100 | B1 | 12/2001 | Liu et al. | |
| 6,331,217 | B1 | 12/2001 | Burke et al. | |
| 6,439,838 | B1 | 8/2002 | Crall et al. | |
| 6,619,916 | B1 | 9/2003 | Capozzi et al. | |
| 6,851,264 | B2 | 2/2005 | Kirtley et al. | |
| 6,883,303 | B1 | 4/2005 | Seda | |
| 6,983,608 | B2 | 1/2006 | Allen, Jr. et al. | |
| 7,055,304 | B2 | 6/2006 | Courtot et al. | |
| 7,097,420 | B2 | 8/2006 | Cormier et al. | |
| 7,134,838 | B2 | 11/2006 | Dube et al. | |
| 7,238,003 | B2 | 7/2007 | Synnott et al. | |
| 7,322,797 | B2 | 1/2008 | Lee et al. | |
| 7,544,040 | B2 | 6/2009 | Marke et al. | |
| 7,549,839 | B2 | 6/2009 | Carroll et al. | |
| 7,553,129 | B2 | 6/2009 | Hoeger et al. | |
| 7,753,652 | B2 | 7/2010 | Truckenmueller et al. | |
| 7,985,053 | B2 | 7/2011 | Schott et al. | |
| 8,061,969 | B2 | 11/2011 | Durocher et al. | |
| 8,091,371 | B2 | 1/2012 | Durocher et al. | |
| 8,096,746 | B2 | 1/2012 | Durocher et al. | |
| 8,099,962 | B2 | 1/2012 | Durocher et al. | |
| 8,182,204 | B2 | 5/2012 | Durocher et al. | |
| 8,192,153 | B2 | 6/2012 | Harvey et al. | |
| 8,197,196 | B2 | 6/2012 | Davis et al. | |
| 8,245,518 | B2 | 8/2012 | Durocher et al. | |
| 8,425,185 | B2 | 4/2013 | Myoren et al. | |
| 8,678,760 | B2 * | 3/2014 | Clemen | F01D 5/141 415/209.1 |
| 8,684,684 | B2 | 4/2014 | Clements et al. | |
| 8,696,306 | B2 | 4/2014 | Clemen | |
| 8,979,499 | B2 | 3/2015 | Allen-Bradley | |
| 8,997,494 | B2 | 4/2015 | Chuang et al. | |
| 9,068,460 | B2 | 6/2015 | Suciu et al. | |
| 9,115,588 | B2 | 8/2015 | Nash | |
| 9,133,713 | B2 | 9/2015 | Allen-Bradley | |
| 9,175,693 | B2 | 11/2015 | Dutka et al. | |
| 9,243,511 | B2 | 1/2016 | Lee et al. | |
| 9,249,736 | B2 | 2/2016 | Carroll | |
| 9,284,845 | B2 | 3/2016 | Lewis et al. | |
| 2006/0018760 | A1 | 1/2006 | Bruce et al. | |
| 2006/0024158 | A1 | 2/2006 | Hoeger et al. | |
| 2006/0275110 | A1 * | 12/2006 | Baralon | F01D 9/041 415/191 |
| 2006/0288686 | A1 * | 12/2006 | Cherry | F01D 5/142 60/226.1 |
| 2007/0092372 | A1 | 4/2007 | Carroll et al. | |
| 2009/0155068 | A1 | 6/2009 | Durocher et al. | |
| 2009/0155069 | A1 | 6/2009 | Durocher et al. | |
| 2009/0324400 | A1 | 12/2009 | Marini et al. | |
| 2010/0080699 | A1 | 4/2010 | Pietrobon et al. | |
| 2010/0111690 | A1 | 5/2010 | Heriz Agiriano et al. | |
| 2010/0132369 | A1 * | 6/2010 | Durocher | F01D 9/065 60/796 |
| 2010/0132371 | A1 | 6/2010 | Durocher et al. | |
| 2010/0132377 | A1 | 6/2010 | Durocher et al. | |
| 2010/0166543 | A1 | 7/2010 | Carroll et al. | |
| 2010/0272566 | A1 | 10/2010 | Durocher et al. | |
| 2010/0275572 | A1 | 11/2010 | Durocher et al. | |
| 2013/0142660 | A1 | 6/2013 | McCaffrey | |
| 2013/0259672 | A1 | 10/2013 | Suciu et al. | |
| 2013/0330180 | A1 | 12/2013 | Guendogdu et al. | |
| 2014/0255159 | A1 | 9/2014 | Paradis et al. | |
| 2014/0314549 | A1 | 10/2014 | Pakkala et al. | |
| 2015/0044032 | A1 | 2/2015 | Paradis et al. | |
| 2015/0098812 | A1 | 4/2015 | Paradis et al. | |
| 2015/0260103 | A1 | 9/2015 | Yu et al. | |
| 2016/0281509 | A1 | 9/2016 | Pons et al. | |

OTHER PUBLICATIONS

International Search Report dated Oct. 6, 2016 in corresponding PCT application No. PCT/CA2016/050801.

Non-Final Office Action dated Jul. 13, 2016 in related U.S. Appl. No. 13/961,136.

Notice of allowance issued in related U.S. Appl. No. 13/961,136 dated Aug. 2, 2017.

* cited by examiner

INTEGRATED STRUT-VANE NOZZLE (ISV) WITH UNEVEN VANE AXIAL CHORDS

CROSS-REFERENCE TO RELATED APPLICATION

The present application claims priority on U.S. Provisional Patent Application No. 62/196,486 filed on Jul. 24, 2015, the content of which is incorporated herein by reference.

TECHNICAL FIELD

The application relates generally to gas turbine engines and, more particularly, to an integrated strut and vane nozzle (ISV).

BACKGROUND OF THE ART

Gas turbine engine ducts may have struts in the gas flow path, as well as vanes for guiding a gas flow through the duct. Conventionally, the struts are axially spaced from the vanes to avoid flow separation problems. This results in longer engine configurations. In an effort to reduce the engine length, it has been proposed to integrate the struts to the vanes. However, heretofore adjusting the flow of the vane nozzle remains challenging.

SUMMARY

In one aspect, there is provided an integrated strut and turbine vane nozzle (ISV) for a gas turbine engine, the ISV comprising: inner and outer duct walls defining an annular flow passage therebetween, an array of circumferentially spaced-apart struts extending radially across the flow passage, and an array of circumferentially spaced-apart vanes extending radially across the flow passage, the vanes having leading edges disposed downstream of leading edges of the struts relative to a direction of gas flow through the annular flow passage, at least one of the struts being aligned in the circumferential direction with an associated one of the vanes and forming therewith an integrated strut-vane airfoil, wherein at least one of adjacent vanes on opposed sides of the integrated strut-vane airfoil has a shorter axial chord than the axial chord of the other vanes of the array of circumferentially spaced-apart vanes.

According to another aspect, there is provided a method of designing an integrated strut and turbine vane nozzle (ISV) having a circumferential array of struts and a circumferential array of vanes, the vanes having leading edges disposed downstream of leading edges of the struts relative to a direction of gas flow through the ISV, each of the struts being aligned in the circumferential direction with an associated one of the vanes and forming therewith an integrated strut-vane airfoil, the method comprising: establishing a nominal axial chord of the vanes, conducting a flow field analysis, and then based on the flow field analysis adjusting the axial chord of the vanes adjacent to the integrated strut-vane airfoil by increasing or decreasing the axial chord thereof relative to the nominal axial chord including shortening the axial chord of a vane adjacent to the integrated strut-vane airfoil when a flow constriction is detected between the vane and the integrated strut-vane airfoil.

According to a further general aspect, there is provided a gas turbine engine comprising a gas path defined between an inner duct wall and an outer duct wall, an array of circumferentially spaced-apart struts extending radially across the gas path, and an array of circumferentially spaced-apart vanes extending radially across the gas path and disposed generally downstream of the struts relative to a direction of gas flow through the gas path, each of the struts being angularly aligned in the circumferential direction with an associated one of the vanes and forming therewith an integrated strut-vane airfoil, each integrated strut-vane airfoil being disposed between two neighbouring vanes, the neighbouring vanes having an uneven axial chord distribution relative to the other vanes, wherein the uneven axial chord distribution comprises at least one of the neighbouring vanes having a shorter axial chord than that of the other vanes.

DESCRIPTION OF THE DRAWINGS

Reference is now made to the accompanying figures, in which.

DETAILED DESCRIPTION

Figure 1:
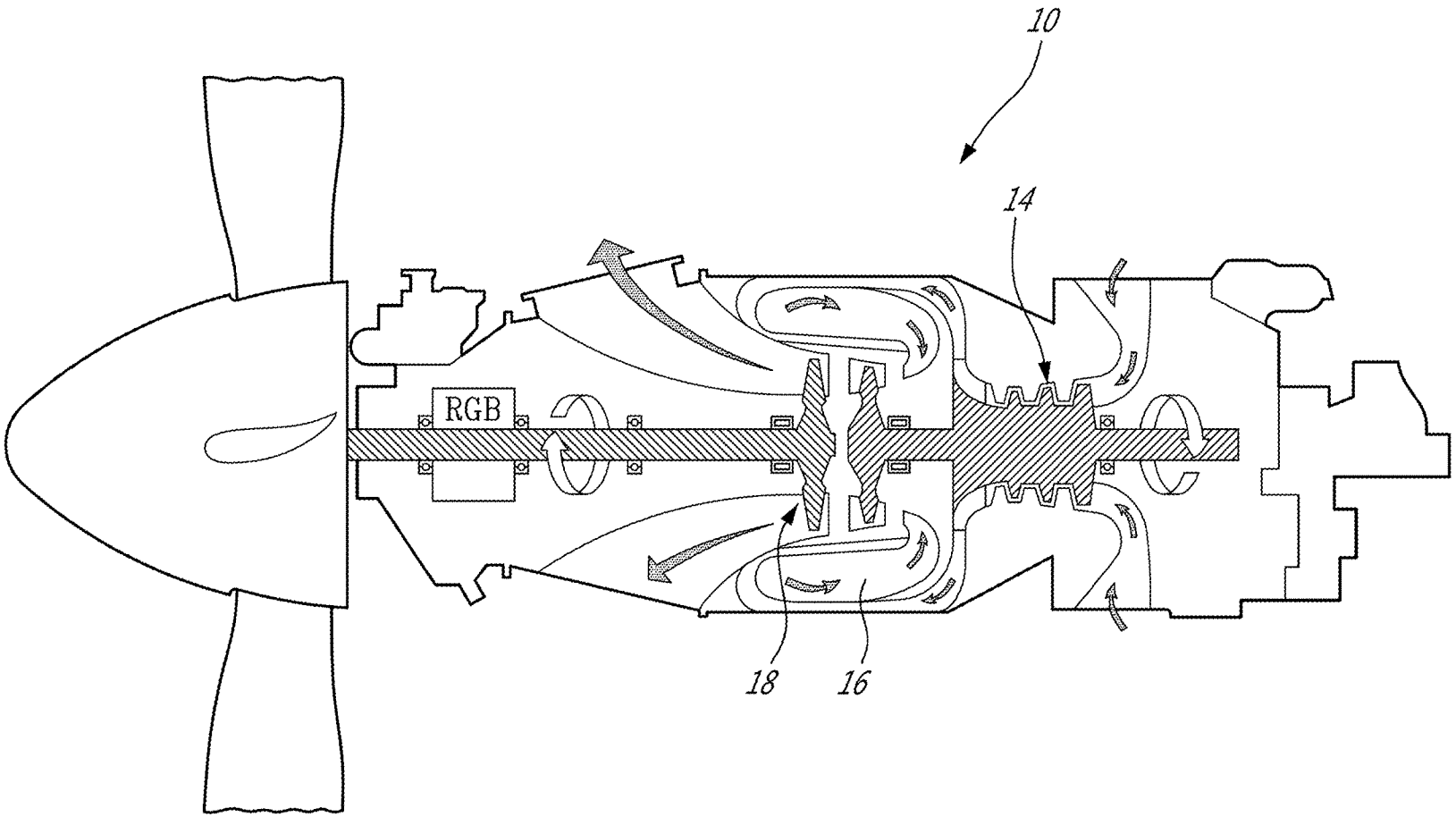
FIG. 1 is a schematic cross-section view of a gas turbine engine.

FIG. 1 illustrates a turboprop gas turbine engine 10 of a type preferably provided for use in subsonic flight, generally comprising in serial flow communication a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
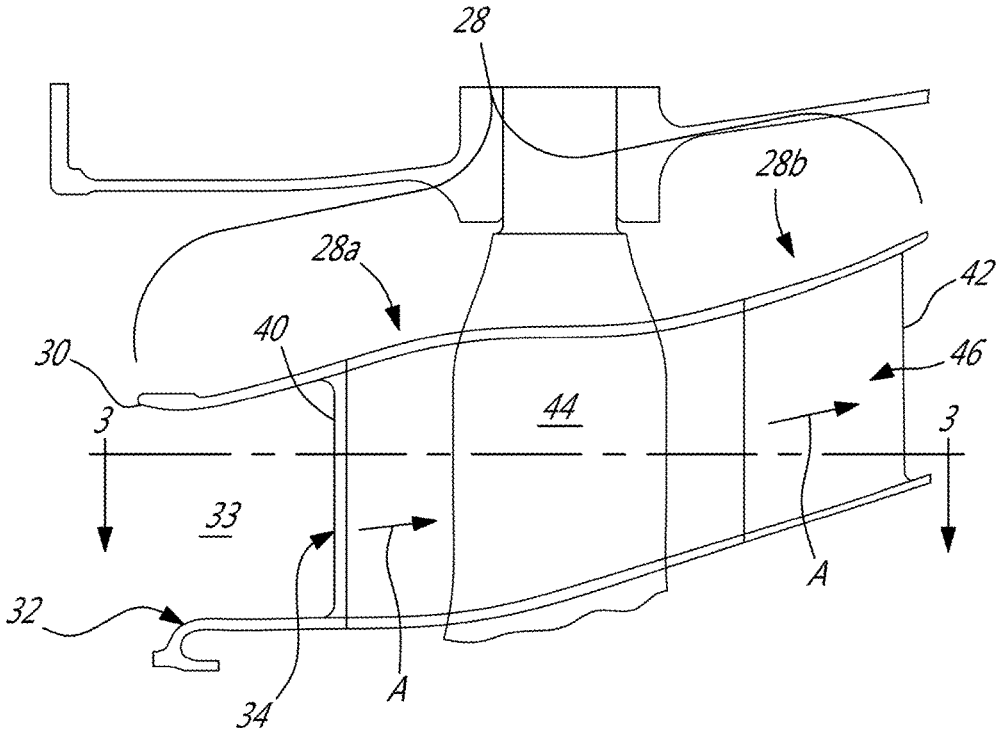
FIG. 2 is a cross-section view of an integrated strut and turbine vane nozzle (ISV) suitable for forming a portion of the gas path of the engine shown in FIG. 1.

FIG. 2 shows an integrated strut and turbine vane nozzle (ISV) 28 suitable for forming a portion of a flow passage, such as the main gas path, of the engine 10. For instance, the ISV could form part of a mid-turbine frame module for directing a gas flow from a high pressure turbine assembly to a low pressure turbine assembly. However, it is understood that the ISV 28 could be used in other sections of the engine 10. Also, it is understood that the ISV 28 is not limited to turboprop applications. Indeed, the ISV 28 could be installed in other types of gas turbine engines, such as turbofans, turboshafts and auxiliary power units (APUs).

Figure 3:
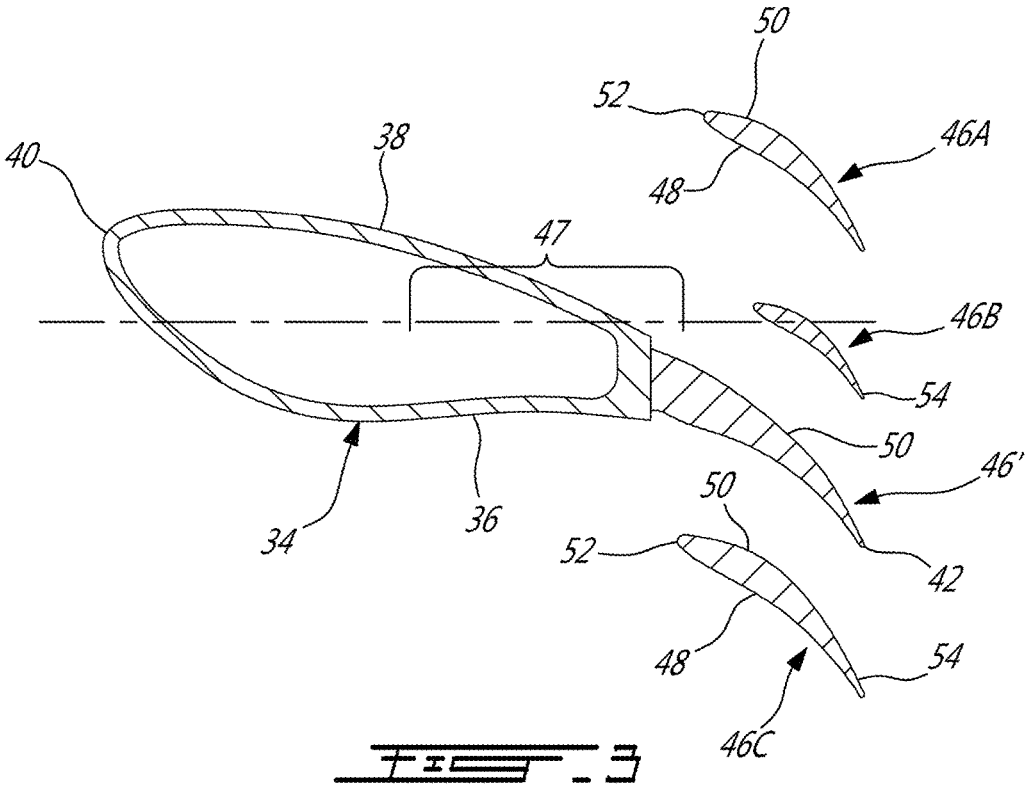
FIG. 3 is a cross-section view taken along line 3-3 in FIG. 2.

The ISV 28 may be of unitary construction or it may be an assembly of multiple parts as for instance shown in FIG. 3. The ISV 28 generally comprises a radially outer duct wall 30 and a radially inner duct wall 32 concentrically disposed about the engine axis and defining an annular flow passage 33 therebetween. The flow passage 33 defines an axial portion of the engine gas path.

Figure 4:
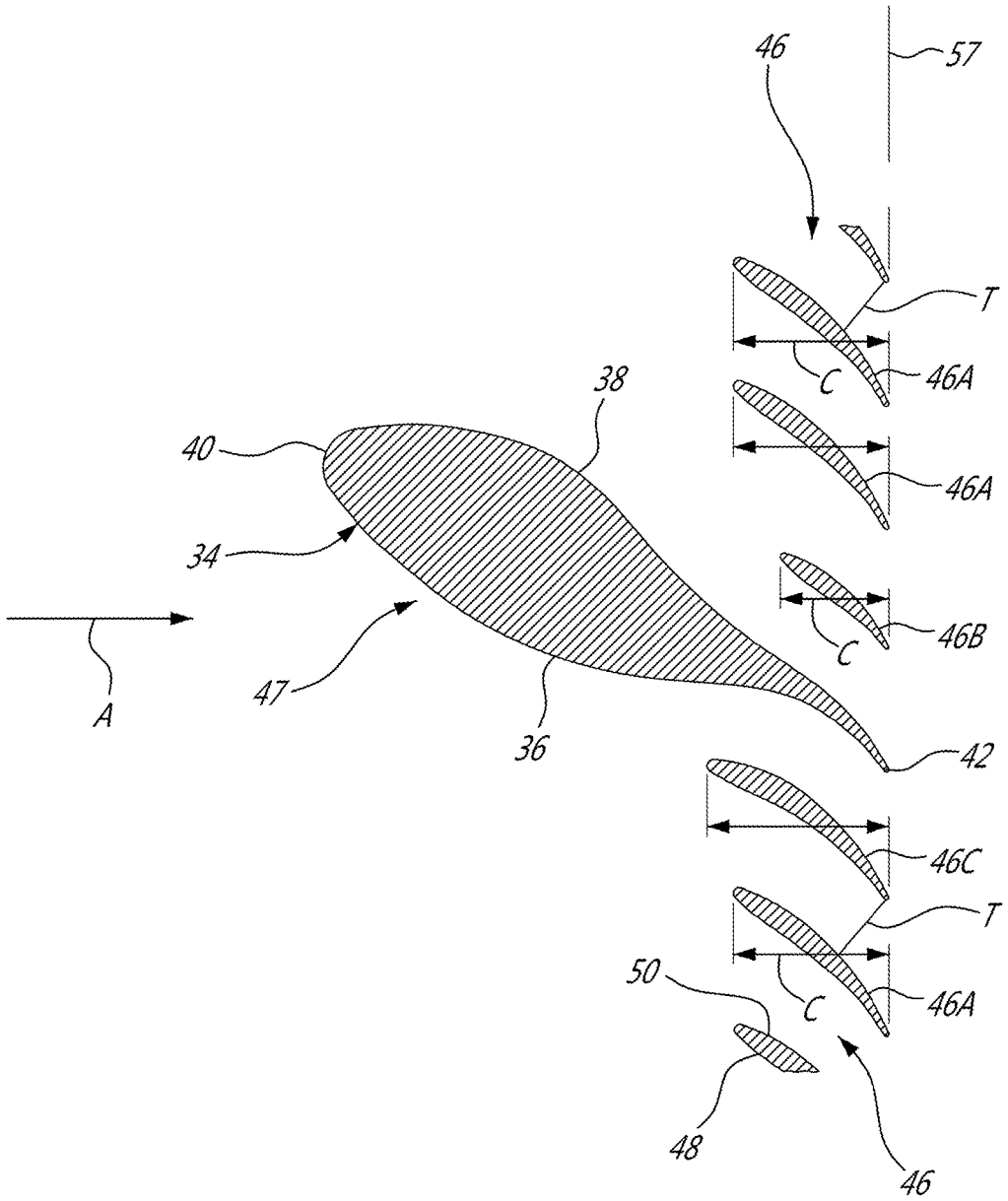
FIG. 4 is a circumferentially extended schematic partial view illustrating a possible uneven axial chord distribution characterized by the vanes on the pressure and suction sides of an integrated strut-vane airfoil respectively having longer and shorter axial chords relative to the nominal chord of the other vanes.

Referring concurrently to FIGS. 2 to 4, it can be appreciated that an array of circumferentially spaced-apart struts 34 (only one shown in FIGS. 2 to 4) extend radially between the outer and inner duct walls 30, 32. The struts 34 may have a hollow airfoil shape including a pressure sidewall 36 and a suction sidewall 38 extending chordwise between a leading edge 40 and a trailing edge 42. Spokes 44 and/or service lines (not shown) may extend internally through the hollow struts 34. The struts 34 may be used to transfer loads and/or protect a given structure (e.g. service lines) from the high temperature gases flowing through the flow passage 33. The ISV 28 has at a downstream end thereof a guide vane nozzle section 28*b* including an array of circumferentially spaced-apart vanes 46 for directing the gas flow to an aft rotor (not shown). The guide vane nozzle section 28*b* may be assembled to the upstream strut section 28*a* of the ISV 28 as for instance described in US Patent Publication No. US2015/0098812, No. US2015/0044032 and No. 2014/0255159, the content of which is incorporated herein by reference.

The vanes 46 have an airfoil shape and extend radially across the flow passage 33 between the outer and inner duct walls 30, 32. The vanes 46 have opposed pressure and suction side walls 48 and 50 extending axially between a leading edge 52 and a trailing edge 54. The leading edges 52 of the vanes 46 are disposed downstream (relative to a direction of the gas flow through the annular flow passage 33 as depicted by A in FIG. 4) of the leading edges 40 of the struts 34. The trailing edges 54 of the vanes 46 and the trailing edges 42 of the struts 34 extend to a common radial plane depicted by line 57 in FIG. 4.

Each strut 34 is angularly aligned in the circumferential direction with an associated one of the vanes 46 to form an integrated strut-vane airfoil 47 (FIGS. 3 and 4). The integration is made by combining the airfoil shape of each strut 34 with the airfoil shape of the associated vane 46' (FIG. 3). Accordingly, each of the struts 34 merges in the downstream direction into a corresponding one of the vanes 46 of the array of guide vanes provided at the downstream end of the flow passage 33. As can be appreciated from FIGS. 3 and 4, the pressure and suctions sidewalls 48 and 50 of the vanes 46', which are aligned with the struts 34, extend rearwardly generally in continuity to the corresponding pressure and suction sidewalls 36 and 38 of respective associated struts 34. As shown in FIG. 4, each vane 46 has an axial chord C corresponding to an axial distance between the leading edge 52 and the trailing edge 54 of the vane 46.

The vanes 46 have typically identical airfoil shape. Therefore, the inter-vane passages on each side of the integrated strut-vane airfoil 47 are different than the inter-vane passages between the vanes 46. It is herein proposed to modify this area to further optimize the efficiency and the ISV losses and reduce the axial distance between the vane nozzle and the aft rotor.

For instance, in order to minimize losses and avoid separation zones, one or both of the adjacent vanes 46B, 46C on opposed sides of the integrated strut-vane airfoil 47 (i.e. the neighbouring vanes of the integrated strut-vane airfoil 47; that is the vanes immediately next to/on either side of the ISV airfoil) can have different airfoil shapes and, more particularly, different axial chords than that of the other vanes 46. For instance:

a) either neighbouring vane 46B or 46C can have longer axial chord C relative to the other vanes 46A;

b) vane 46B can have a longer axial chord C and vane 46C can have a shorter axial chord C relative to vanes 46A;

c) vane 46C can have a longer axial chord C and vane 46B can have a shorter axial chord C relative to vanes 46A (this specific combination is illustrated in FIG. 4);

d) only one of vane 46B or vane 46C could have a shorter axial chord C than the axial chord C of the other vanes 46A; or e) both neighbouring vanes 46B and 46C could have shorter axial chords C relative to vane 46A.

The above combinations of uneven axial chords may be implemented to provide at least one of the following benefits:

Equalized mass flow distribution at the exit of the vane nozzle.

Minimized losses.

Reduced static pressure gradient at the exit of the vane nozzle.

Minimize strut wake at the exit of the vane nozzle.

Reduce engine length by positioning the aft rotor closer to the vane nozzle.

The axial chord distribution of the adjacent vanes 46B, 46C of the ISV is function of the Tmax/c ratio, where "tmax" is the maximum thickness of the integrated strut-vane airfoil 47 and "c" is the true chord of the integrated strut-vane airfoil 47. If the location of the maximum thickness of the integrated strut vane 47 is too close to the leading edge 52 of one of the adjacent vanes 46B, 46C (which means small true chord c and hence large tmax/c ratio), the distance between the integrated strut vane surface and the adjacent vane 46B or 46C might be smaller than the throat T (i.e. the smallest cross-sectional area between two adjacent airfoils, which is usually at the trailing edge), thereby creating an upstream flow constriction in the inter-vane passage. As a result of this situation, the flow is trapped at the inlet of the inter-vane passage between the integrated strut-vane and the adjacent vane, creating a choke or constriction which leads to flow separation and blockage of the whole inter-vane passage. To overcome this problem, one option in designing the ISV is to shorten the adjacent vane 46B or 46C where this phenomenon is detected while conducting a flow field analysis on an analytical model of the ISV. On the other hand, if during the flow field analysis, flow separation is observed upstream of the leading edges 52 of the vanes 46 on either side of the integrated strut-vane airfoil 47, the axial chord C of the adjacent vane 46B, 46C where flow separation was observed can be increase so that the leading edge of the extended vane be positioned upstream of the flow separation site to intercept the flow separation. By so extending the axial chord of a vane at a pressure or suction side of the integrated strut-vane airfoil 47, additional guidance can be provided to the flow where flow separation would normally occur and, thus, flow separation can be avoided.

Accordingly various combinations of uneven axial chords of the adjacent vanes 46B, 46C are possible depending on the results of the flow field analysis. From the foregoing, a person skilled in the art will appreciate that depending on the flow field that exists around each integrated strut-vane airfoil 47, and the separation zones observed (on the integrated strut-vane airfoil surfaces, in the inter-vane passages on opposed sides of the integrated strut-vane airfoil 47, as well as on the adjacent vane surfaces), the designer might consider extending or shortening the adjacent vane(s) 46B, 46C neighboring each integrated strut-vane airfoil 47 in order to either increase the axial chord to better guide the flow and avoid flow separation or reduce the axial chord to open up an inter-vane passage where flow constriction is detected.

In addition to the above chord length re-sizing, the adjacent vanes 46B and 46C on opposed sides of the integrated strut-vane airfoil 47 can be re-staggered (modifying the stagger angle defined between the chord line of the vane and the turbine axial direction) to provide improved aerodynamic performances. Also the front portion of these airfoils might be different than the remaining airfoils to better match the strut transition.

When designing an ISV, the designer may start with a same nominal axial chord for all the vanes 46, including the vanes 46B and 46C adjacent to the integrated strut-vane airfoils 47. A flow field analysis may then be performed on a computerized model of the initial design of the ISV. In view of the flow field analysis, the designer may thereafter increase or reduce the axial chord or length of the vanes 46B, 46C relative to the initially fixed nominal axial chord. For instance, if flow separation is observed at one side of an integrate strut-vane airfoil 47 upstream of where the adjacent vane 46B, 46C ends, the designer may increase the length of the adjacent vane 46B, 46C to guide the flow upstream of where flow separation was detected, thereby preventing flow separation to occur in the modified design. If for example, the designer see that a converging and then diverging inter-vane passage is formed at one side of an integrated strut-vane airfoil 47, the designer may shorten the axial chord of the adjacent vane 46B, 46C so as to open up the upstream portion of the inter-vane passage and, thus, eliminate the constriction at the entry end of the passage. The adjacent vane 46B, 46C may be shortened so that the leading edge thereof is downstream of an axial point at which a distance between the integrated strut-vane airfoil 47 and the leading edge of the adjacent vane becomes less than a shortest distance between the integrated-strut vane airfoil 47 and a remainder of the vane 46B, 46C. The vane 46B, 46C may be shortened by a length sufficient to eliminate a detected flow constriction upstream of the throat T at the trailing edge 54 of the vane 46B, 46C. For instance, a vane 46B, 46C adjacent to an integrated strut-vane airfoil 47 may be shortened relative to the other vanes 46A so as to prevent an area of maximum thickness of the integrated strut-vane airfoil 47 and a leading edge portion of the adjacent vane 46B, 46C from being spaced by a distance, which is less than a distance between a trailing edge 54 of the adjacent vane 46B, 46C and the integrated strut-vane airfoil 47 as measured perpendicularly thereto.

Therefore, based on the flow filed observed on the numerical model, the initial axial chord of the vanes adjacent to the integrated strut-vane airfoils is adjusted to provide for a more uniform mass flow distribution around the turbine nozzle.

The above description is meant to be exemplary only, and one skilled in the art will recognize that changes may be made to the embodiments described without departing from the scope of the invention disclosed. It is also understood that various combinations of the features described above are contemplated. For instance, different airfoil designs could be provided on either side of each integrated strut-vane airfoil in combination with a re-stagger of the vanes adjacent to the integrated airfoil structure. These features could be implemented while still allowing for the same flow to pass through each inter-vane passage. Still other modifications which fall within the scope of the present invention will be apparent to those skilled in the art, in light of a review of this disclosure, and such modifications are intended to fall within the appended claims.

What is claimed is:

1. An integrated strut and turbine vane nozzle (ISV) for a gas turbine engine, the ISV comprising: inner and outer duct walls defining an annular flow passage therebetween, an array of circumferentially spaced-apart struts extending radially across the flow passage, and an array of circumferentially spaced-apart vanes extending radially across the flow passage, the vanes having leading edges disposed downstream of leading edges of the struts relative to a direction of gas flow through the annular flow passage, at least one of the struts being aligned in the circumferential direction with an associated one of the vanes and forming therewith an integrated strut-vane airfoil, wherein at least one of adjacent vanes on opposed sides of the integrated strut-vane airfoil has a shorter axial chord than the axial chord of the other vanes of the array of circumferentially spaced-apart vanes.

2. The ISV defined in claim 1, wherein both the adjacent vanes on the opposed sides of the integrated strut-vane have a shorter axial chord than the axial chord of the other vanes.

3. The ISV defined in claim 1, wherein a first one of the adjacent vanes has a longer axial chord than the axial chord of the other vanes while a second one of the adjacent vanes has a shorter axial chord than the axial chord of the other vanes.

4. The ISV defined in claim 1, wherein both adjacent vanes on opposed sides of the integrated strut-vane airfoil have uneven axial chords relative to the other vanes.

5. The ISV defined in claim 1, wherein the adjacent vanes have substantially a same axial chord which is different from the axial chord of the other vanes.

6. The ISV defined in claim 3, wherein the first one of the adjacent vanes extends upstream relative to the other vanes to a location where flow separation is anticipated during operation.

7. The ISV defined in claim 1, wherein the at least one of the adjacent vanes having a shorter axial chord is disposed on a suction side of the integrated-strut vane airfoil.

8. The ISV defined in claim 1, wherein the adjacent vanes and the integrated strut-vane airfoil define first and second inter-vane passages respectively on opposed sides of the integrated strut-vane airfoil, and wherein the at least one of the adjacent vanes having an axial chord shorter than the axial chord of the other vanes is shorter by a distance sufficient to avoid the of a throat at an inlet end of the first and second inter-vane flow passages.

9. The ISV defined in claim 8, wherein the throat of the first and second inter-vane flow passages is substantially positioned at a trailing edge of the adjacent vanes.

10. The ISV defined in claim 1, wherein the at least one of the adjacent vanes is shorter relative to the other vanes so that an area of maximum thickness of the integrated strut-vane airfoil and a leading edge portion of the at least one of the adjacent vanes is spaced by a distance less than a distance between a trailing edge of the at least one of the adjacent vanes and the integrated strut-vane airfoil as measured perpendicularly thereto.

11. The ISV defined in claim 1, wherein the leading edge of the at least one of the adjacent vanes is downstream of the leading edges of the other vanes having a nominal axial chord relative to the direction of gas flow through the annular flow passage, and wherein the leading edge of the at least one of the adjacent vanes having a shorter axial chord is downstream of an axial point at which a distance between the integrated strut-vane airfoil and the leading edge of the at least one of the adjacent vanes become less than a shortest distance between the integrated-strut vane airfoil and the at least one of the adjacent vanes downstream of the leading edge of the at least one of the adjacent vanes.

12. A method of designing an integrated strut and turbine vane nozzle (ISV) having a circumferential array of struts and a circumferential array of vanes, the vanes having leading edges disposed downstream of leading edges of the struts relative to a direction of gas flow through the ISV, each of the struts being aligned in the circumferential direction with an associated one of the vanes and forming therewith an integrated strut-vane airfoil, the method comprising: establishing a nominal axial chord of the vanes, conducting a flow field analysis, and then based on the flow field analysis adjusting the axial chord of the vanes adjacent to the integrated strut-vane airfoil by increasing or decreasing the axial chord thereof relative to the nominal axial chord including shortening the axial chord of a vane adjacent to the integrated strut-vane airfoil when a flow constriction is detected between the vane and the integrated strut-vane airfoil.

13. The method of claim 12, wherein increasing or decreasing the axial chord of the vanes adjacent to the integrated strut vane airfoil includes increasing the axial chord of an adjacent vane on a side of the integrated strut-vane airfoil when flow separation is detected on said side of the integrated strut-vane airfoil at a location upstream of the leading edge of the adjacent vane, the axial chord being increased for the leading edge of the adjacent vane to extend axially upstream of where flow separation was detected.

14. The method defined in claim 12, wherein the integrated strut-vane airfoil has a tmax/c ratio, wherein tmax is the maximum thickness of the integrated-strut vane airfoil and c the true chord of the integrated strut-vane airfoil, wherein conducting a flow field analysis comprises calculating the tmax/c ratio, and wherein adjusting the axial chord of the vanes adjacent to the integrated strut-vane airfoil comprises shortening an associated one of the vanes adjacent to the integrated strut-vane airfoil when the tmax/c ratio is superior to a predetermined value.

15. The method defined in claim 12, wherein when a converging and then diverging passage between the integrated strut-vane airfoil and an adjacent vane is detected during the flow filed analysis, the adjacent vane is shortened to eliminate the flow constriction.

16. The method defined in claim 12, wherein at least one of the vanes adjacent to the integrated strut-vane airfoil is shortened relative to the other vanes so as to prevent an area of maximum thickness of the integrated strut-vane airfoil and a leading edge portion of the at least one vane from being spaced by a distance that is less than a distance between a trailing edge of the at least one vane and the integrated strut-vane airfoil as measured perpendicularly thereto.

17. The method defined in claim 12, wherein at least one of the vanes adjacent to the integrated strut-vane airfoil is shortened so that the leading edge thereof is downstream of an axial point at which a distance between the integrated strut-vane airfoil and the leading edge of the at least one vane becomes less than a shortest distance between the integrated-strut vane airfoil and a remainder of the at least one vane.

18. A gas turbine engine comprising a gas path defined between an inner duct wall and an outer duct wall, an array of circumferentially spaced-apart struts extending radially across the gas path, and an array of circumferentially spaced-apart vanes extending radially across the gas path and disposed generally downstream of the struts relative to a direction of gas flow through the gas path, each of the struts being angularly aligned in the circumferential direction with an associated one of the vanes and forming therewith an integrated strut-vane airfoil, each integrated strut-vane airfoil being disposed between two neighbouring vanes, the neighbouring vanes having an uneven axial chord distribution relative to the other vanes, wherein the uneven axial chord distribution comprises at least one of the neighbouring vanes having a shorter axial chord than that of the other vanes.

19. The gas turbine engine defined in claim 18, wherein the at least one neighbouring vane with the shorter axial chord has a leading edge which is disposed downstream of leading edges of the other vanes relative to a direction of gas flow through the gas path.

20. The gas turbine engine defined in claim 18, wherein the uneven axial chord distribution further comprises at least one of the neighbouring vanes having a longer axial chord than that of the other vanes.

* * * * *